US005566769A

United States Patent [19]

Stuart

[11] Patent Number: 5,566,769

[45] Date of Patent: Oct. 22, 1996

[54] TUBULAR ROTATION TOOL FOR SNUBBING OPERATIONS

[75] Inventor: Randolph L. Stuart, Odessa, Tex.

[73] Assignee: Eckel Manufacturing Company, Inc., Odessa, Tex.

[21] Appl. No.: 332,117

[22] Filed: Oct. 31, 1994

[51] Int. Cl.[6] ..... E21B 19/16; E21B 3/00

[52] U.S. Cl. ..... 173/149; 173/167; 173/56

[58] Field of Search ..... 173/53, 54, 55, 173/56, 49, 92, 149, 167; 175/203, 162, 195

[56] References Cited

U.S. PATENT DOCUMENTS

| | | | |
|---|---|---|---|
| 3,722,603 | 3/1973 | Brown | 173/149 X |
| 3,888,318 | 6/1975 | Brown | 173/149 |
| 4,074,774 | 2/1978 | Brown et al. | 173/149 X |
| 4,085,796 | 4/1978 | Council | 173/149 X |
| 4,226,447 | 10/1980 | Brown | 173/197 X |
| 4,290,495 | 9/1981 | Elliston | 173/147 X |

*Primary Examiner*—Scott A. Smith
*Assistant Examiner*—Jay A. Stelacone
*Attorney, Agent, or Firm*—Browning Bushman

[57] ABSTRACT

A tool 60 for rotating a tubular member 80 passing through a slip assembly 66 is powered by a rotary table 62 of a drilling rig. Tool 60 includes a cam ring 8 having a plurality of interior camming surfaces 82 thereon, and a cage plate assembly 84 rotatable with respect to the cam ring 8 and housing one or more gripping heads 94 for gripping engagement with the tubular 80. A powered drive unit 55 is provided for selectively rotating the cage plate assembly 84 with respect to the cam ring 8. A tool mount 10 removably connects the slip assembly and the cage plate assembly, and one or more axial adjustment members 17 permit limited axial movement of the cam ring 8 with respect to the slip assembly so that the gripping heads retain gripping engagement with the tubular member 80 while moving axially with respect to the body of the slip assembly.

19 Claims, 4 Drawing Sheets

TUBULAR ROTATION TOOL FOR SNUBBING OPERATIONS

FIELD OF THE INVENTION

The present invention relates to equipment and techniques for performing workover or snubbing operations commonly used in the petroleum recovery industry. More particularly, the tool of this invention operates in conjunction with a conventional rotary table to increase the reliability of workover and snubbing operations.

BACKGROUND OF THE INVENTION

Drilling rigs used throughout the world for oil recovery operations include a rotary table which is powered by a draw works. A kelly having a rectangular outer configuration mates with and is rotated by a drilling rig rotary table. The lower end of the kelly includes threads for mating engagement with drill pipe thread. Accordingly, the drilling fig draw works rotates the rotary table, which rotates the kelly, which then rotates the drill pipe.

Those skilled in the petroleum recovery industry appreciate that the cost of recovering hydrocarbons can be significantly reduced by utilizing a workover rig or a snubbing unit to perform workover and/or snubbing operations. The utility of a drilling rig is thus increased by using this high cost rig almost exclusively for drilling operations. A workover rig, which practically may consist of a much smaller drilling rig, is thus frequently used for workover operations. A typical workover operation may involve the drilling or milling of a downhole packer or other tool out of a well. A workover rig can perform this operation at a fraction of the cost of utilizing a drilling rig.

A snubbing unit is similar to a workover rig, and typically has the additional capability of allowing the workover operation without "killing" the well. The snubbing unit typically has a raised work platform thirty feet or more off the rig floor. A snubbing unit thus does not require a derrick or draw works, and allows oilfield tubular goods to be made up at the raised work platform while high pressure drilling tools keep the well under pressure. A suitable snubbing unit may be used for snubbing in a kill string, for sand washing operations, for drilling through bridges, for drilling or milling packers or plugs, for fishing operations, or for pulling or running tubing in a cased well.

When conducting workover operations, it is typically not essential that the workover string continually be rotated in the wellbore. When pulling or running tubing, for example, the workover string is typically stationary as the upper tubular is threaded by a power tong to the stationary lower tubular. When conducting snubbing operations, however, the high well pressure increases the likelihood that a stationary workover string will become stuck in the wellbore. While snubbing operations have significant advantages compared to workover operations where the well is killed, a recognized disadvantage of a snubbing operation is that the workover string may become stuck in a wellbore. When this occurs, remedial operations to "unstick" the string can be very expensive and time consuming. In some instances, it is also desirable to rotate a work string during a conventional workover operation even when the well is killed.

The disadvantages of the prior art are overcome by the present invention. Improved techniques and equipment are hereinafter disclosed which allow the reliable and cost effective rotation of a workover string during the snubbing or workover operations. More particularly, the tool of the present invention allows for the rotation of the entire work string when making up or breaking apart a threaded joint at the well.

SUMMARY OF THE INVENTION

The pipe rotating tool of the present invention operates in conjunction with a rig rotary table for selective rotation of a downhole tubular string, even when making up or breaking apart a tubular joint. The techniques of the present invention substantially reduce the likelihood of a work string becoming stuck in a wellbore, particularly during snubbing operations. A conventional draw works rotates the rotary table, and slips mounted on the rotary table prevent inadvertent axial movement of the workover string with respect to the rotary table. The rotary tool of this invention may be bolted on top of the slips to grip and rotate the work string with the rotary table.

The pipe rotating tool includes a plurality of cam surfaces each for bringing a respective sliding head into gripping engagement with the workover string. A hydraulic drive motor may be used to rotate a cage plate assembly which houses the sliding heads with respect to a cam ring fixed within a tool body. This limited rotational movement causes each cam follower of a sliding head to ride up a respective cam surface and bring the head into gripping engagement with the tubular. Biasing springs are provided for mounting the cage plate assembly with respect to slip connecting brackets, so that the rotary tool maintains reliable gripping engagement with the workover tubular even when the tubular moves axially slightly with respect to the slip body in response to a varying axial load or weight.

It is an object of this invention to provide improved methods and apparatus for selectively rotating a downhole tubular string. It is a further object of this invention to provide improved techniques for reducing the likelihood of a work string becoming stuck in a wellbore.

In the feature of the invention the work string may be selectively rotated during snubbing operations. It is a further feature of the invention that the work string may be rotated even when making up or breaking apart a work string joint at the surface.

A significant advantage of the invention is that snubbing operations may be reliably performed while reducing the likelihood of the work string becoming stuck in a wellbore. It is a further advantage of the invention that the work string may be reliably gripped by a pipe rotating tool, and that the power source used to rotate the rotary table of the rig is used to operate in conjunction with the pipe rotating tool to selectively rotate the work string.

These and further objects, features and advantages of the present invention will become apparent from the following detailed description, wherein references are made to the figures in the accompanying drawings.

DETAILED DESCRIPTION OF THE PREFERRED EMBODIMENTS

Figure 1:
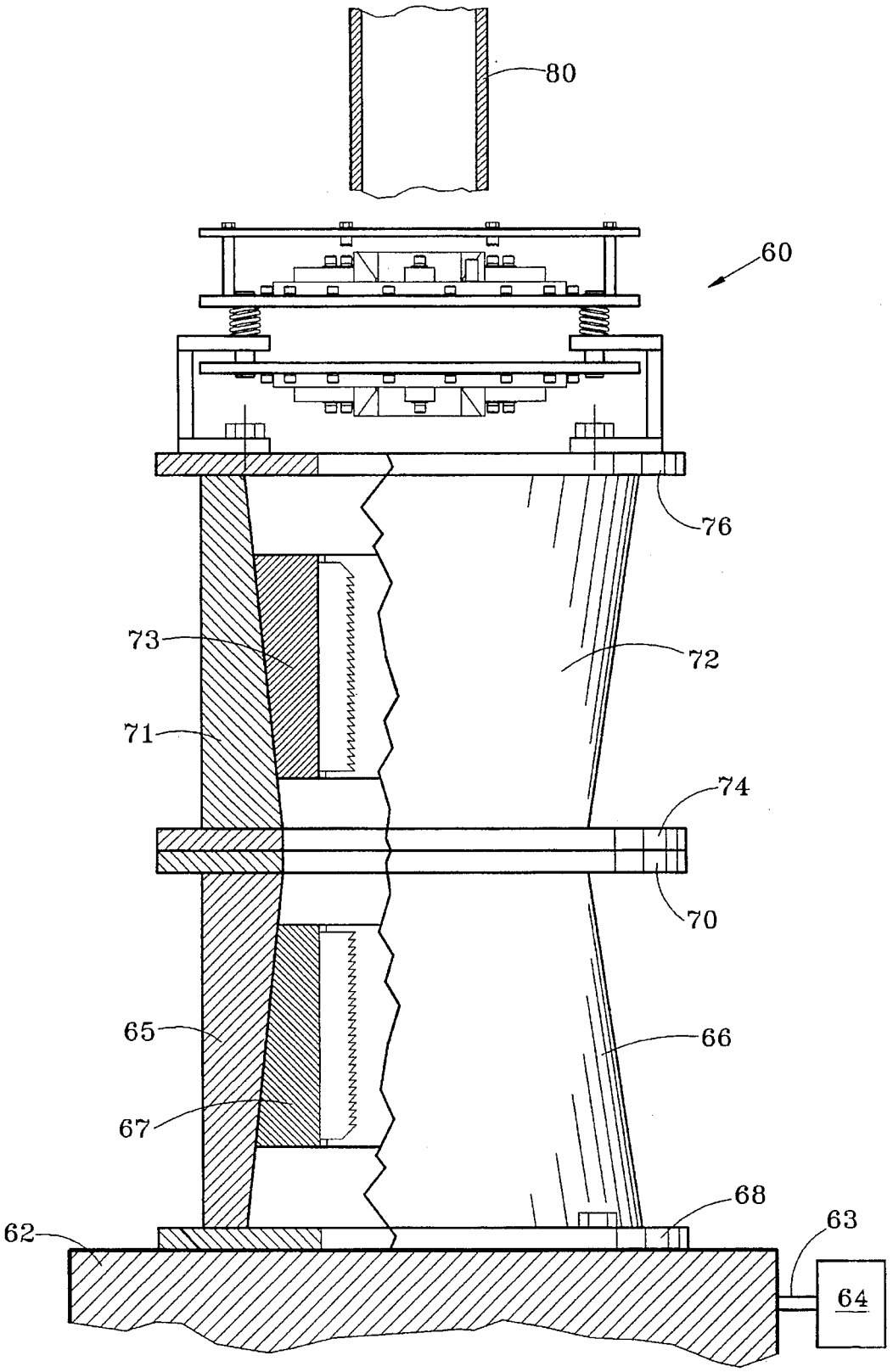
FIG. 1 is a pictorial view, partially in cross-section, of a portion of a rotary table of a rig, a set of lower slips, a set of upper slips, and a pipe rotating tool according to the present invention removably mounted on the upper set of upper slips.

FIG. 1 discloses a suitable tool for rotating a tubular member according to the present invention. As explained more fully below, the tool operates in conjunction with a rotary table 62 which may be powered by a drive mechanism 64 having an output shaft 63 interconnected with the rotary table 62. The drive mechanism 64 typically may be a draw works of a drilling rig, although any suitable means can be provided for rotating the rotary table.

Positioned on the rotary table is a lower slip assembly 66 having an outer body 65 and a plurality of slips 67 for mating engagement with the tubular member to prevent inadvertent downward axial movement of the tubular member 80 with respect to rotary table. Since high upward forces may also be transmitted to the tubular member, the assembly as shown in FIG. 1 also includes an upper slip assembly 72 having a slip body 71 and a plurality of convention slips 73 for gripping engagement with the tubular. The lower slip assembly 66 is provided with a lower flange 68 for removable interconnection to the rotary table 62. An upper flange 70 on the lower slip assembly 66 mates with a lower flange 74 on the upper slip assembly 72. An upper flange 76 on the slip assembly 72 is provided for supporting the tool 60.

For the sake of simplicity, only a short portion of a tubular member 80 is shown in FIG. 1 positioned above the tool 60. Those skilled in the art will appreciate that the tubular member 80 passes through tool 60, then through a bore in the upper slip assembly 72, through a bore in the lower slip assembly 66, then through a bore in the rotary table 62, so that the tubular member 80 extends downhole into a wellbore. The equipment as shown in FIG. 1 is particularly useful for workover or snubbing operation, and related equipment to perform these operations is typically provided above the tool but not depicted in FIG. 1. Those skilled in the art will appreciate that the tool 60 of the present invention provides gripping engagement with the tubular 80, which may be tubing, casing or any other tubular forming a workover string. As explained more fully below, the tool 60 operates in conjunction with the rotary table 62 and with either one slip assembly or two slip assemblies to substantially reduce the likelihood of the work string 80 will become stuck in a wellbore during snubbing or workover operations.

Figure 2:
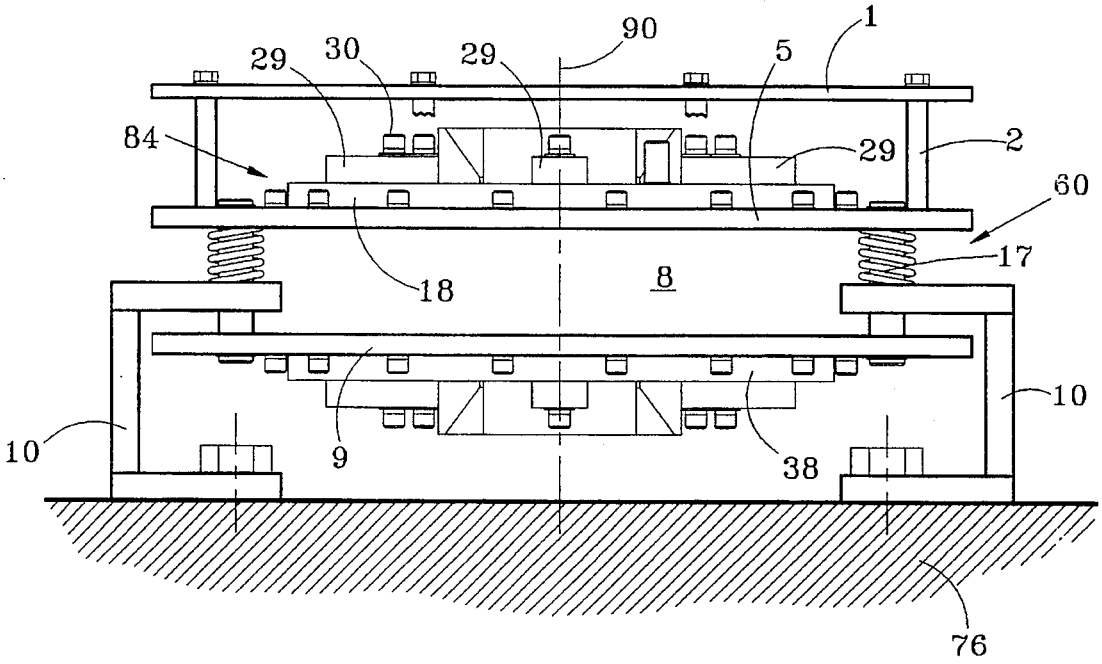
FIG. 2 is a front view of the pipe rotating tool shown in FIG. 1.
Figure 5:
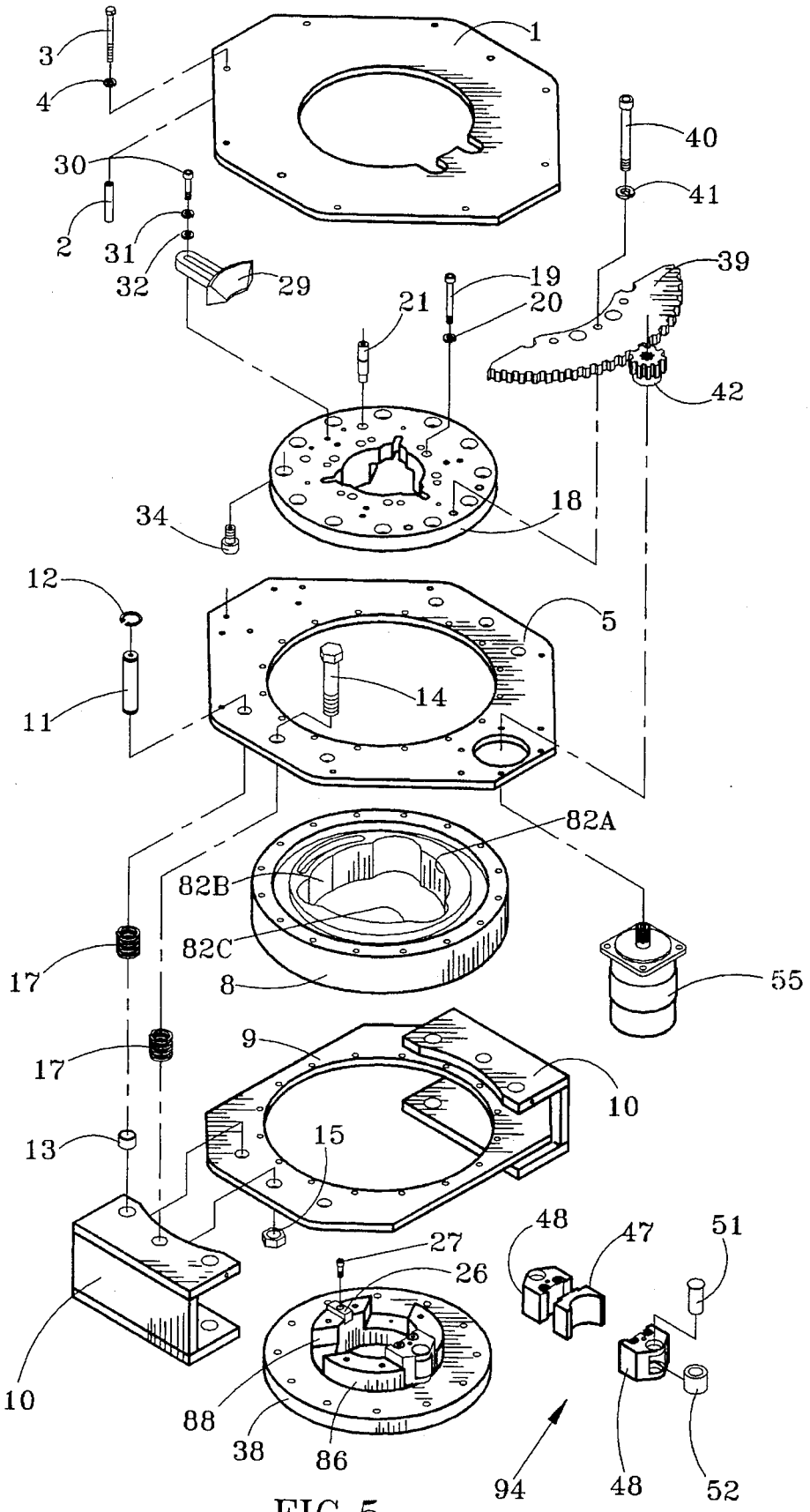
FIG. 5 is an exploded view of the pipe rotating tool according to the present invention.

FIG. 2 depicts in greater detail a suitable embodiment of a pipe rotating tool 60 in accordance with the present invention. The primary components of the pipe rotating tool 60 comprise a cam ring 8 having three camming surfaces 82A, 82B, and 82C formed on the interior surface thereof, as shown in FIG. 5. A cage plate assembly 84 is rotatably supported on the cam ring 8, and comprises a top cage plate 18 and a bottom cage plate 38. Integral with the bottom cage plate is a cage plate body 86 (see FIG. 5) which has three guide slots 88 therein, each circumferentially and uniformly spaced about the centerline 90 of the tool 60. A similar cage plate body with three corresponding slots is provided in the upper cage plate 18, so that 18 and 38 are structurally similar. A gripping head 94 as shown in FIG. 5 consists of a gripping head body 48, a die 47 removably mounted on the gripping head body for engagement with the tubular, and a roller 52 rotatably mounted on the body 48 by pin 51 for engagement with a corresponding cam surface on the cam ring 8. One gripping head 94 is shown in one of the three guide slots 88 in FIG. 5. The other two guide slots are not provided with a gripping head for clarity of the slots 88. The heads 94 thus each slidably move with respect to cage plate body 86 in a radial direction to engage or disengage the tubular member 80.

A top plate 5 and a bottom plate 9 are each fixed to the cam ring. The cam ring and thus the cage plate assembly are supported on a pair of tool mounts 10 each having a generally U-shaped cross-sectional configuration. A plurality of coil springs 17 serve as axial adjustment members for allowing limited axial movement of the cage plate assembly with respect to the slip assembly body, as explained subsequently, so that the gripping heads may retain gripping engagement with the tubular member 80 while the tubular member moves axially with respect to the slip assembly body in response to limited axial movement of the plurality of slips with respect to a corresponding slip assembly body.

A guard plate 1 is fixed above the cage plate assembly and is supported from the top plate 5 by a plurality of pin-like spacers 2. A hex head bolt 3 and lock washer 4 cooperate with the spacer pin 2 to interconnect the guard plate 1 and the top plate 5. The guard plate 1 serves as both a guard to protect operators from moving parts within the tool 60, and also protects the cage plate assembly from inadvertent damage.

Figure 3:
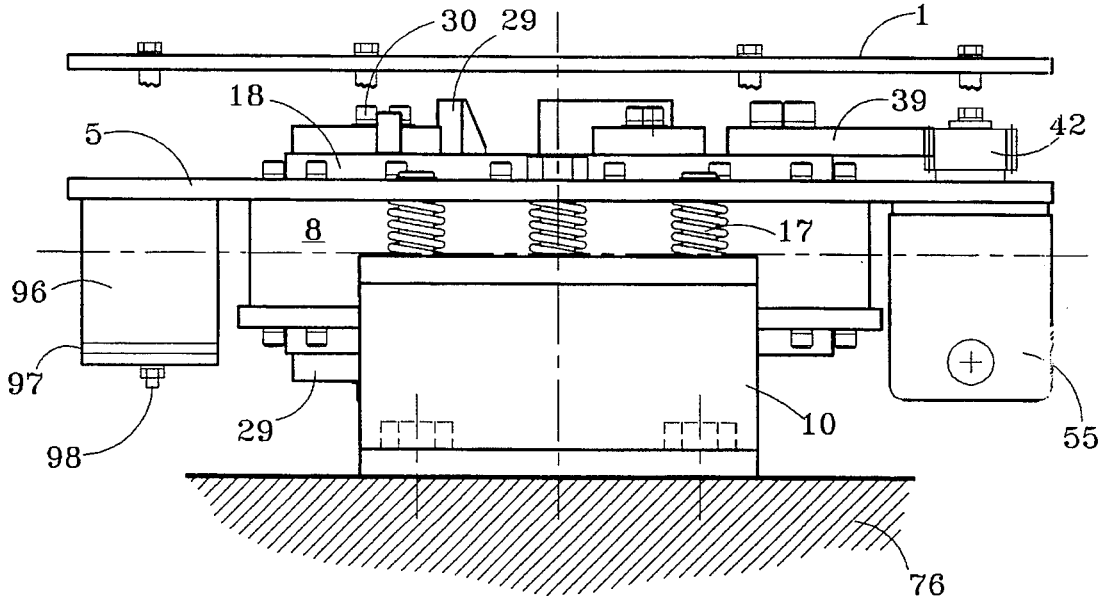
FIG. 3 is a fight side view of a pipe rotating tool shown in FIG. 2.

FIG. 3 is a side view of the tool 60 shown in FIG. 2, with each of the spacer pins 2 being broken away for clarity of the remaining components. As shown in FIGS. 2 and 3, the tool 60 includes a plurality of coil springs 17 for serving as axial adjustment members, as noted above. Four or more coil springs are preferably provided for this purpose, and six such springs are shown in the depicted tool. Three pipe guides 29 are mounted on the top cage plate 18 and are removably interconnected thereto by securing members 30, which as shown in FIG. 5 may consist of socket-head bolts and washers 31 and 32. The three pipe guides 29 may be spaced uniformly about the circumference of the cage plate assembly, and serve to guide the tubular member while passing through the cage plate assembly 84. Similar pipe guides 29 may optionally be provided on the bottom of the lower cage plate assembly 38, and serve the same purpose of guiding the tubular member with respect to the tool when pulling tubing from a well.

FIG. 3 also depicts a hydraulic drive motor 55 which may be used for rotating motor gear 42. As explained subsequently, gear 42 meshes with the partial gear segment 39 to cause limited rotational movement of the cage plate assembly 84 with respect to the cam ring and thereby cause the heads 94 to engage or disengage the tubular member 80. To properly balance and align the cage plate assembly 84 with the tubular member 80, a counter-weight 96 is secured to the top plate 5. The weight of the drive motor 55 and the related drive components 42 and 39 may thus be counter-balanced by weight 96 so that the cage plate assembly remains properly aligned and so that the heads 94 uniformly engage the oilfield tubular. The desired balancing of the counterweight may be easily obtained by adding or subtracting additional counter-weight plates 97 removably connected by bolt member 98. Since the entire assembly 60 is rotated by the rotary table, the counterweight 96 also offsets the centrifugal force created by the weight of the motor, so that the rotating assembly 60 does not tend to wobble off center.

Figure 4:
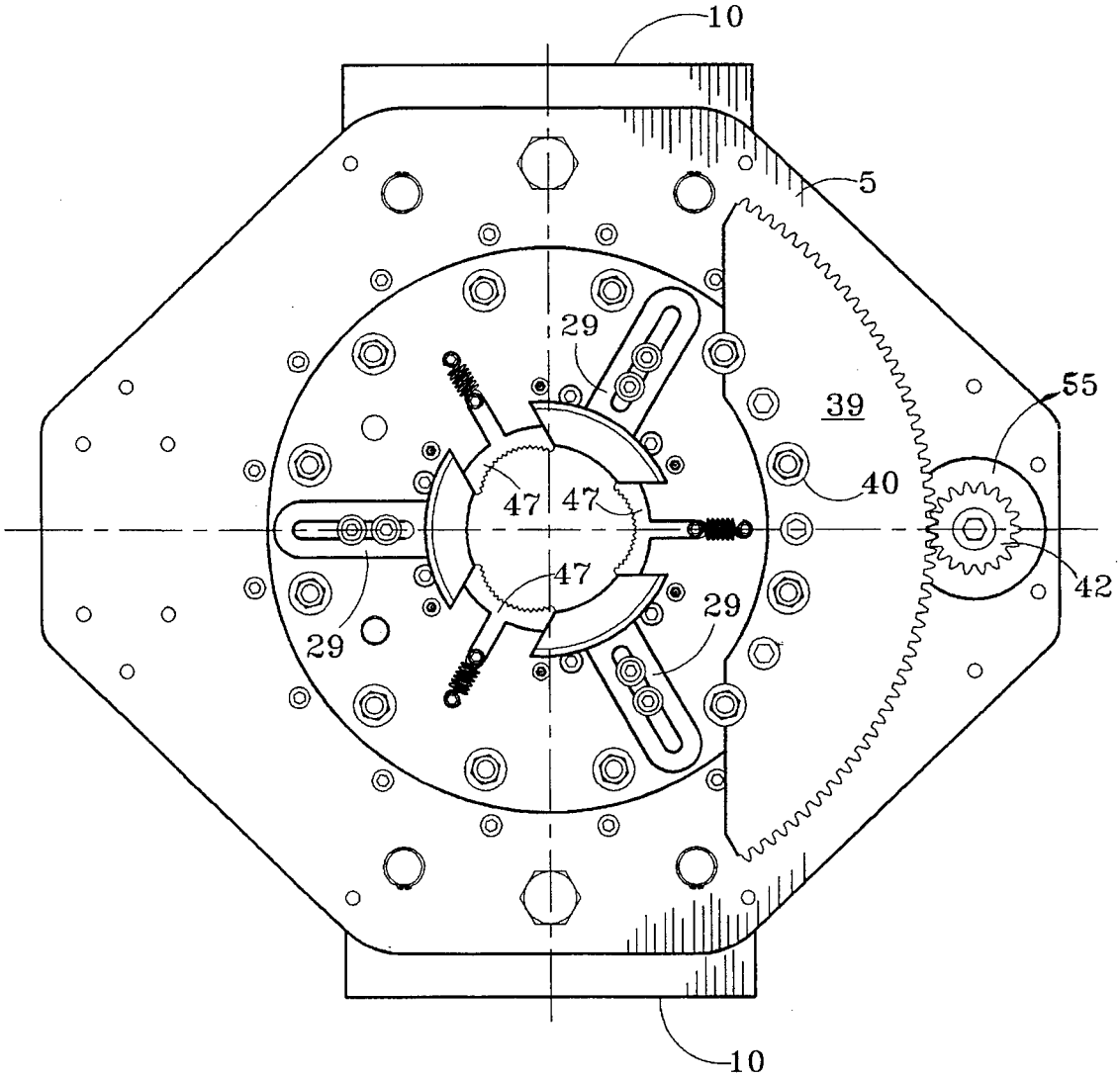
FIG. 4 is a top view of the pipe rotating tool shown in FIG. 2.

FIG. 4 depicts the uniform arrangement of the heads 94 and particularly the dies 47, as well as the uniform circumferential spacing of the top pipe guides 29. Gear segment 39 may be mounted on the cage plate assembly 84 by a plurality of securing members, such as bolts 40 and washers 41 as shown in FIG. 5. When the motor 55 is activated, the gear 42 rotates, thus rotating the gear segment 39 with respect to the top plate 5.

As shown in FIG. 5, connecting pin 11 and snap ring 12 serve to interconnect the top plate 5 and the mount 10. A plurality of bolts 14 and lock nuts 15 serve as a mount for a corresponding spring so that the weight of the cage plate assembly 15 is supported on the coil springs. The compression springs 17 allow the weight of the top plate 5 and thus the cage plate assembly 84 to be supported by the springs 17, so that limited axial movement of the cage plate assembly with respect to the slip assembly is achieved. The beating races 13 provide a bearing surface for the pins 11.

Still referring to FIG. 5, cage plate bolts 19 and lock washers 20 interconnect the top cage plate and the bottom cage plate 38. A backing pin 21 is provided for positioning within a selected aperture in the top plate to stop the heads 94 in their neutral position and prevent the heads from inadvertently gripping the pipe once the heads pass the neutral position. Cam followers 34 are provided for rotatably guiding the cage plate assembly with respect to the cam ring 8 during activation of the motor 55.

Tool 60 as disclosed herein may be similar in many respects to a backup power tong, such as the tong disclosed in U.S. Pat. No. 4,290,304. Accordingly, numerous washers, mounting bolts, grease zerts and similar components have been removed for FIG. 5 for clarity of the primary components discussed above.

According to the method of the present invention, a cam ring and a cage plate assembly are supported on a slip assembly, as shown in FIG. 1. Preferably a mount 10 is provided with selectively spaced through apertures or slots for receiving conventional bolts for removably interconnecting the assembly 60 with the top plate 76 of a slip assembly. The cam ring has one or more interior camming surfaces thereon, and the cage plate assembly is provided with roller bearings for rotating the cage plate assembly to a limited extent with respect to the cam ring to cause the head rollers 52 to ride up a respective cam surface, thereby bringing the plurality of heads 94 simultaneously into gripping engagement with a pipe. Accordingly, a threaded joint of the tubular member 80 may be made up or broken apart at a position slightly above the tool 60. During this operation, the rotary table may be powered by draw works 64 to rotate the tubular member 80 while it passes through the tool 60 and through the slip assemblies, so that the entire workover string within the wellbore is rotated during the makeup or break out operation, thereby substantially reducing the likelihood of the workstring becoming stuck in the well. In a typical operation, an upper section of tubular may be rotated by a power tong at a relatively high RPM, while the lower tubular is rotated by the rotary table and the tool 60 of the present invention at a substantially lower RPM (but in the same makeup direction as the power tong) which is sufficient to prevent the workover string from becoming stuck in the wellbore.

Those skilled in the art will appreciate that a tubular member may move slightly with respect to the slip bodies in response to a varying axial load or weight being applied to the workover string. This limited axial movement of the tubular member with respect to the slip assembly bodies and thus with respect to the rotary table is desirable so that the plurality of slips maintain reliable gripping engagement with a pipe in response to this varying load or weight. According to the present invention, the tool includes a plurality of springs or other axial adjustment members for allowing limited axial movement of the cage plate assembly with respect to the slip assembly body, so that the one or more gripping heads of the tool retain reliable gripping engagement even if the tubular member moves slightly with respect to the slip assembly body.

Various modifications may be made to the tool as discussed above. While it is preferable that the tool include three heads each radially moveable in response to the roller tiding up a respective cam surface on a closed loop cam ring, a tool could include only two moveable heads and one fixed head, or possibly one head and two fixed heads. To reliably grip the tubular member, it is preferable that each of the gripping heads be radially moveable with respect to the cam ring. Each gripping head preferably includes a roller rotatably mounted with respect to head body for rolling up a respective cam surface, although the roller could be replaced with an arcuate guide surface on the gripping head body for sliding engagement with the cam surface. As previously noted, the cam ring preferably has a closed loop configuration, i.e., a full 360° ring with no opening or slot. The closed loop configuration substantially increases the strength of the cam ring and prevents undesirable spreading.

The powered drive unit for selectively rotating the cage plate assembly with respect to the cam ring preferably includes a hydraulic motor and a partial gear secured to the cage plate assembly, as disclosed above. Various other drive mechanisms could be used for achieving the desired rotation of the cage plate assembly with respect to the cam ring. Those skilled in the art will understand that the cage plate assembly may rotate approximately 30° to move the heads from a neutral position out of engagement with the tubular member to a position wherein each head is in reliable gripping engagement with the tubular member.

Coil springs are preferably used as axial adjustment members for supporting the cage plate assembly and allowing the gripping heads 94 to maintain gripping engagement with tubular member 80 even when the tubular member 80 moves slightly with respect to the slip assembly body during slight axial movement of the plurality of slips within the slip assembly body. Those skilled in the art will understand that this movement is very limited, and typically the slips will move only a slight amount within the slip assembly body in response to the varying load on the tubular member. As previously noted, it is important that the tool 60 of the present invention allow the slip assemblies to move with respect to the slip body while maintaining reliable engagement with the tubular member for rotating the tubular member during makeup and break out operations.

Although the invention has been described in terms of specific embodiments which are set forth in detail, one should understand that this is by illustration only, and that the invention is not limited thereto. Alternative embodiments and operating techniques will become apparent to those skilled in the art in view of this disclosure. Such modifications are contemplated and may be made by those skilled in the art without departing from the spirit of the invention.

What is claimed:

1. A tool for rotating a tubular member passing through a slip assembly of a drilling rig, the slip assembly including an outer body fixed with respect to a powered rotary table and a plurality of slips for gripping engagement with the tubular member to prevent substantial inadvertent axial movement of the tubular member with respect to the drilling rig, the tool comprising:

a cam ring having one or more interior camming surfaces thereon;

a cage plate assembly rotatable with respect to the cam ring and housing one or more gripping heads each radially positioned inwardly of the cam ring for gripping engagement with the tubular member, the one or more gripping heads cooperating with a respective camming surface to move the one or more gripping heads radially with respect to the tubular member upon rotation of the cage plate assembly with respect to the cam ring;

a powered drive unit for selectively rotating the cage plate assembly with respect to the cam ring;

a tool mount for removably interconnecting the slip assembly body and the cage plate assembly; and an axial adjustment member for allowing limited axial movement of the cam ring in the cage plate assembly with respect to the slip assembly body, such that the one or more gripping heads may retain gripping engagement with the tubular member while moving axially with respect to the slip assembly body in response to limited axial movement of the plurality of slips with respect to the slip assembly body.

2. The tool as defined in claim 1, further comprising:

the cam ring includes at least three camming surfaces thereon; and the cage plate assembly houses at least three gripping heads each slidably moveable within a respective guide slot within a cage plate body, such that each gripping head is radially moveable with respect to the cage plate body for gripping engagement with the tubular member upon rotation of the cage plate assembly with respect to the cam ring.

3. The tool as defined in claim 2, wherein each of the gripping heads further includes:

a head body for sliding engagement with the cage plate body;

a die carried by the head body and having a plurality of radially internal gripping teeth for gripping engagement with the tubular member; and a roller rotatably mounted with respect to the head body for engagement with a respective cam surface on the cam ring.

4. The tool as defined in claim 1, wherein the cam ring has a closed loop configuration to prevent spreading of the cam ring.

5. The tool as defined in claim 1, wherein the powered drive unit comprises:

a drive gear;

a drive motor for rotating the drive gear; and a partial gear secured to the cage plate assembly for mating engagement with the drive gear.

6. The tool as defined in claim 5, wherein the drive motor is a hydraulically powered motor.

7. The tool as defined in claim 1, wherein the axial adjustment member comprises a plurality of coil springs for supporting the cam ring on the tool mount.

8. The tool as defined in claim 7, further comprising:

a counterbalance weight for offsetting the weight of the powered drive unit and thereby balancing the tool during rotation by the powered rotary table.

9. The tool as defined in claim 1, wherein the tool mount includes a first mounting bracket and an opposing second mounting bracket, each of the first and second mounting brackets having a generally U-shaped cross-sectional configuration.

10. The tool as defined in claim 1, further comprising:

a guard plate positioned above the cage plate assembly and fixed with respect to the cam ring.

11. The tool as defined in claim 1, further comprising:

the tool mount includes a first mounting bracket and an opposing second mounting bracket, each of the first and second mounting brackets having a generally U-shaped cross-sectional configuration; and a guard plate positioned above the cage plate assembly and fixed with respect to the cam ring.

12. A tool for rotating a tubular member passing through a slip assembly of a drilling rig, the slip assembly including an outer body fixed with respect to a powered rotary table and a plurality of slips for gripping engagement with the tubular member to prevent substantial inadvertent axial movement of the tubular member with respect to the drilling rig, the tool comprising:

a cam ring having a closed loop configuration and a plurality of interior camming surfaces thereon;

a cage plate assembly rotatable with respect to the cam ring and housing a plurality of gripping heads each radially positioned inwardly of the cam ring for gripping engagement with the tubular member, the plurality of gripping heads each cooperating with a respective camming surface to move the plurality of gripping heads radially with respect to the tubular member upon rotation of the cage plate assembly with respect to the cam ring;

a powered drive unit for selectively rotating the cage plate assembly with respect to the cam ring;

a tool mount for removably interconnecting the slip assembly body and the cage plate assembly; and an axial adjustment member for allowing limited axial movement of the cam ring in the cage plate assembly with respect to the slip assembly body, such that the plurality of gripping heads may retain gripping engagement with the tubular member while moving axially with respect to the slip assembly body in response to limited axial movement of the plurality of slips with respect to the slip assembly body.

13. The tool as defined in claim 12, wherein the powered drive unit comprises:

a drive gear;

a drive motor for rotating the drive gear; and a partial gear secured to the cage plate assembly for mating engagement with the drive gear.

14. The tool as defined in claim 12, wherein the axial adjustment member comprises a plurality of coil springs for supporting the cam ring on the tool mount.

15. The tool as defined in claim 14, further comprising:

a counterbalance weight for offsetting the weight of the powered drive unit and thereby balancing the tool during rotation by the powered rotary table.

16. A tool for rotating a tubular member passing through a slip assembly of a drilling rig, the slip assembly including an outer body and a plurality of slips for gripping engagement with the tubular member to prevent substantial inadvertent axial movement of the tubular member, the tool comprising:

a cam ring having one or more interior camming surfaces thereon;

a cage plate assembly rotatable with respect to the cam ring and housing one or more gripping heads each radially positioned inwardly of the cam ring for gripping engagement with the tubular member, the one or more gripping heads cooperating with a respective camming surface to move the one or more gripping heads radially with respect to the tubular member upon rotation of the cage plate assembly with respect to the cam ring;

a powered drive unit for selectively rotating the cage plate assembly with respect to the cam ring;

first and second tool mounts for removably interconnecting the slip assembly body and the cage plate assembly, each of the first and second tool mounts having a generally U-shaped cross-sectional configuration; and a plurality of biasing members for supporting the cam ring on the tool mount and for allowing limited axial movement of the cam ring in the cage plate assembly with respect to the slip assembly body, such that the one or more gripping heads may retain gripping engagement with the tubular member while moving axially with respect to the slip assembly body in response to limited axial movement of the plurality of slips with respect to the slip assembly body.

17. The tool as defined in claim 16, wherein the powered drive unit comprises:

a drive gear;

a drive motor for rotating the drive gear; and a partial gear secured to the cage plate assembly for mating engagement with the drive gear.

18. The tool as defined in claim 16, further comprising:

a counterbalance weight for offsetting the weight of the powered drive unit.

19. The tool as defined in claim 16, further comprising:

a guard plate positioned above the cage plate assembly and fixed with respect to the cam ring.

* * * * *